US011597229B2

(12) United States Patent
Mondine

(10) Patent No.: US 11,597,229 B2
(45) Date of Patent: Mar. 7, 2023

(54) BOOKMARK ASSEMBLY

(71) Applicant: Oscar C. Mondine, Fort Worth, TX (US)

(72) Inventor: Oscar C. Mondine, Fort Worth, TX (US)

( * ) Notice: Subject to any disclaimer, the term of this patent is extended or adjusted under 35 U.S.C. 154(b) by 624 days.

(21) Appl. No.: 16/598,948

(22) Filed: Oct. 10, 2019

(65) Prior Publication Data

US 2021/0107309 A1 Apr. 15, 2021

(51) Int. Cl.
*B42D 9/00* (2006.01)

(52) U.S. Cl.
CPC ..... *B42D 9/007* (2013.01)

(58) Field of Classification Search
CPC ..... B42D 9/007; B42D 9/008; B42D 9/00
USPC ..... 40/726; 281/42
See application file for complete search history.

(56) References Cited

U.S. PATENT DOCUMENTS 10,052,902 B1 * 8/2018 Joseph ..... B42D 9/007
2018/0043722 A1 * 2/2018 Liu ..... B42D 9/007

* cited by examiner

*Primary Examiner* — Justin V Lewis
(74) *Attorney, Agent, or Firm* — Law Office of Jeff Williams PLLC; J. Oliver Williams

(57) ABSTRACT

Embodiments of the present invention disclose a bookmark assembly that indicates relative page direction and a line left off for a reader. The assembly includes a hollow sleeve member having a window and a slot, a marker configured to translate through the hollow sleeve member, and a line indicator configured to translate along the slot.

17 Claims, 4 Drawing Sheets

BOOKMARK ASSEMBLY

BACKGROUND

1. Field of the Invention

The present application relates to the field of bookmarks, and more particularly to a bookmark that indicates a portion of text on a page for continuation.

2. Description of Related Art

Bookmarks mark the page where a reader last left off reading. Typical bookmarks are inserted by a reader between two pages in a book that indicates approximately where the reader left, and the book is closed and put away. When the reader decides to resume the book, the reader opens the book to the two pages where the bookmark was last inserted.

However, traditional bookmarks only indicate what page the reader left off and do not indicate which page the reader left off. For example, while traditional bookmarks indicate a position in a book based on the placement of the bookmark between two pages, bookmarks fail to indicate which of the two pages (e.g., left page or right page) the reader would like to resume. To add to the ambiguity of the stored position of the bookmark, the bookmark fails to indicate which line, sentence, or paragraph the reader left off. As such, an improved bookmark is desired that stores and indicates which page of the two pages relative to the bookmark position the reader would like to resume as well as an indicator that directs the reader to a line, sentence, or paragraph on the page.

SUMMARY OF THE INVENTION

Embodiments of the present invention disclose a bookmark assembly that indicates relative page direction and a line left off for a reader. In one embodiment of the present invention, an assembly is provided comprising: a hollow sleeve member having a first face and a second face, the sleeve member also including a window, the window located between a first opening and a second opening, the sleeve member having a slot passing through at least one of the first face and the second face along a length of the sleeve member; a marker configured to translate through the hollow sleeve member, the marker including graphical indicia on a first side selectively displayed through the window; and a line indicator coupled to the slot with a fastener and configured to translate along the slot.

Ultimately the invention may take many embodiments. In these ways, the present invention overcomes the disadvantages inherent in the prior art.

The more important features have thus been outlined in order that the more detailed description that follows may be better understood and to ensure that the present contribution to the art is appreciated. Additional features will be described hereinafter and will form the subject matter of the claims that follow.

Many objects of the present application will appear from the following description and appended claims, reference being made to the accompanying drawings forming a part of this specification wherein like reference characters designate corresponding parts in the several views.

Before explaining at least one embodiment of the present invention in detail, it is to be understood that the embodiments are not limited in its application to the details of construction and the arrangements of the components set forth in the following description or illustrated in the drawings. The embodiments are capable of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the various purposes of the present design. It is important, therefore, that the claims be regarded as including such equivalent constructions in so far as they do not depart from the spirit and scope of the present application.

DESCRIPTION OF THE DRAWINGS

The novel features believed characteristic of the application are set forth in the appended claims. However, the application itself, as well as a preferred mode of use, and further objectives and advantages thereof, will best be understood by reference to the following detailed description when read in conjunction with the accompanying drawings, wherein:

Figure 1:
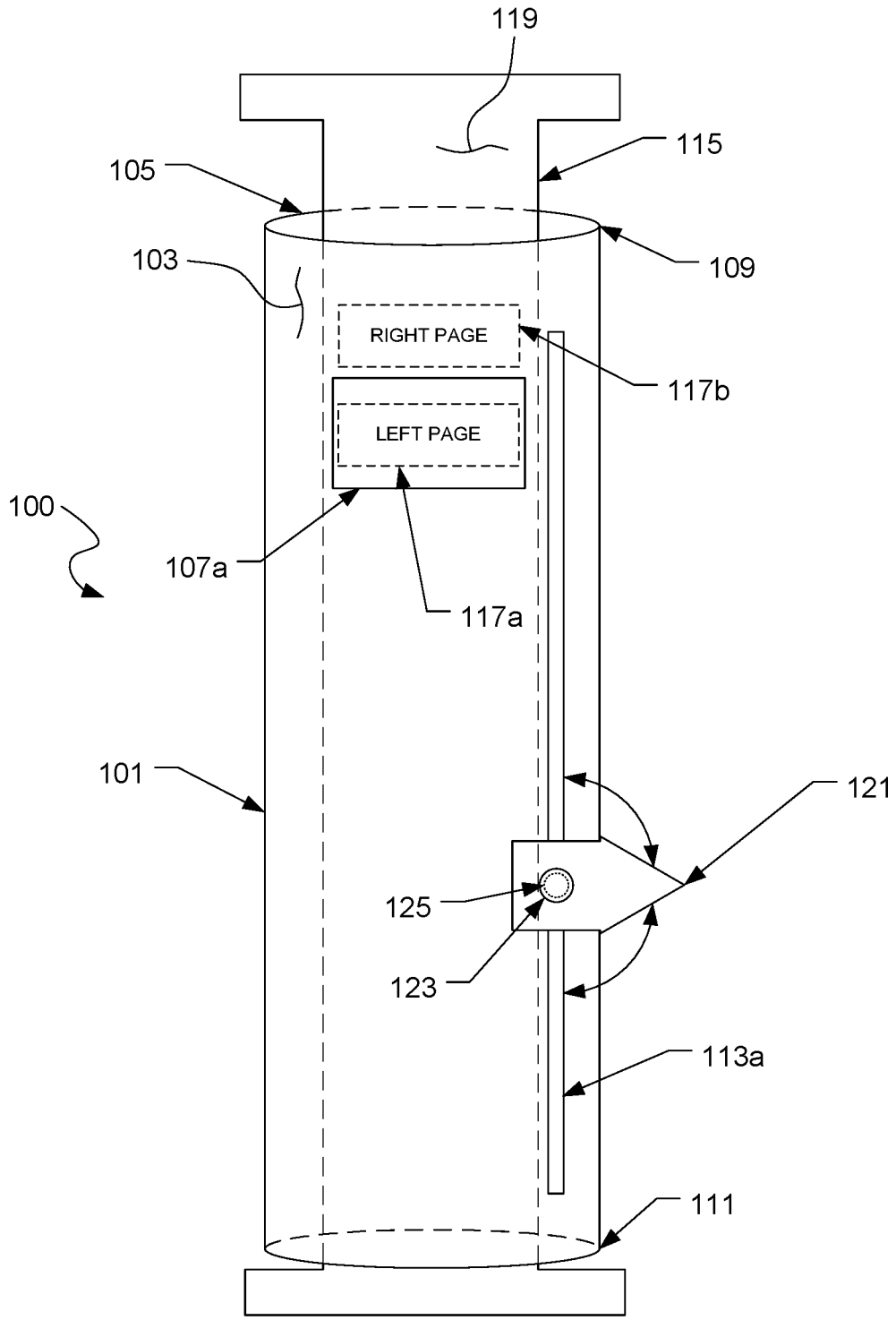
FIG. 1 is a bookmark assembly, in accordance with an embodiment of the present invention.

While the embodiments and method of the present application is susceptible to various modifications and alternative forms, specific embodiments thereof have been shown by way of example in the drawings and are herein described in detail. It should be understood, however, that the description herein of specific embodiments is not intended to limit the application to the particular embodiment disclosed, but on the contrary, the intention is to cover all modifications, equivalents, and alternatives falling within the spirit and scope of the process of the present application as defined by the appended claims.

DETAILED DESCRIPTION OF THE PREFERRED EMBODIMENT

Illustrative embodiments of the preferred embodiment are described below. In the interest of clarity, not all features of an actual implementation are described in this specification. It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming but would nevertheless be a routine undertaking for those of ordinary skill in the art having the benefit of this disclosure.

In the specification, reference may be made to the spatial relationships between various components and to the spatial orientation of various aspects of components as the devices are depicted in the attached drawings. However, as will be recognized by those skilled in the art after a complete reading of the present application, the devices, members, apparatuses, etc. described herein may be positioned in any desired orientation. Thus, the use of terms to describe a spatial relationship between various components or to describe the spatial orientation of aspects of such components should be understood to describe a relative relationship between the components or a spatial orientation of aspects of such components, respectively, as the embodiments described herein may be oriented in any desired direction.

The assembly and method in accordance with the present invention overcomes one or more of the above-discussed problems commonly associated with traditional bookmarks. In particular, the system of the present invention is a bookmark assembly having a sleeve member, a line indicator, and a marker that indicates a left/right side page and a line for resuming for reading. These and other unique features of the system are discussed below and illustrated in the accompanying drawings.

The system will be understood from the accompanying drawings, taken in conjunction with the accompanying description. Several embodiments of the system may be presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless otherwise described.

The system of the present application is illustrated in the associated drawings. As used herein, "system" and "assembly" are used interchangeably. As used herein, a "fastener" is a rod-like hardware device that mechanically joins or affixes two or more members together through a respective concentric set of apertures. For example, a fastener can be a screw, bolt, nail, stud, dowel, rivet, staple, etc. in conjunction with any applicable nuts and washers generally known in the art of fastening. It should be noted that the articles "a", "an", and "the", as used in this specification, include plural referents unless the content clearly dictates otherwise. Additional features and functions are illustrated and discussed below.

Referring now to the drawings wherein like reference characters identify corresponding or similar elements in form and function throughout the several views. FIG. 1 a bookmark assembly. FIGS. 2, 3, 4*a*, and 4*b* illustrates components of the bookmark assembly, and FIG. 5 is an embodiment of the bookmark assembly.

Referring now to FIG. 1, bookmark assembly 100 is illustrated in accordance with an embodiment of the present invention.

In FIG. 1, bookmark assembly 100 is a bookmark that stores where a reader left off from reading, including, but not limited to, storing a position in a book between two pages among a plurality of pages of the book, storing graphical indicia that indicate which page among two pages is designated to resume reading, and storing a position on a line indicator corresponding to a line position of text on the designated page. When the reader is ready to resume the book where the reader left off from reading, the reader uses the bookmark assembly to recall where the reader left off in the book by opening the book to the stored position of the bookmark assembly that corresponds to the two pages in the book, determining the page of the two pages to resume reading based on the stored graphical indicia, and determining the line position of text to resume reading based on the stored position of the line indicator.

In this embodiment, bookmark 100 includes, but is not limited to, a sleeve member (i.e., sleeve 101), a line indicator (i.e., line indicator 121), and a marker (i.e., marker 115). Sleeve 101 is a hollow sleeve that permits marker 115 to translate between a first opening (i.e., opening 109) and a second opening (i.e., opening 111). Sleeve 101 has a first face (i.e., face 103) and a second face (i.e., face 105). In this embodiment, sleeve 101 includes at least a rectangular window (i.e., window 107*a*) located on face 103 between the first opening (i.e., opening 109) and the second opening (i.e., opening 111). In this embodiment, sleeve 101 includes a slot (i.e., slot 113*a*) passing through at least one of the first face and the second face along a length of sleeve 101.

In this embodiment, line indicator 121 is an indicator that stores a line position of text. In this embodiment, line indicator 121 is a geometrical shape, wherein the geometrical shape, when placed proximately to a corresponding line position of text, symbolically indicates a corresponding line position of text to a reader. For example, the geometrical shape of indicator 121 can be an arrow, a rectangle, square, or triangle. In FIG. 1, indicator 121 is an arrow. In further embodiments, indicator 121 has an illustrated graphical indicator. For example, indicator 121 can be a square indicator having a red line that points to a corresponding line position of text.

In this embodiment, line indicator 121 has an aperture (i.e., aperture 125), wherein line indicator 121 is coupled to slot 113*a* with a fastener (i.e., fastener 123) via aperture 125 that permits line indicator 121 to translate along slot 113*a*, thereby permitting the reader to translate line indicator 121 to a corresponding line position of text for future recall. In this embodiment, line indicator 121 is coupled to face 103. In another embodiment, line indicator 121 is coupled to face 103 and face 105.

In this embodiment, line indicator 121 is rotatable about face 103 based on fastener 123 and aperture 125.

In this embodiment, marker 115 is a rectangular member configured to translate through the hollow sleeve of sleeve 101. In this embodiment, marker 115 has graphical indicia located on a first side (i.e., side 119) that is selectively displayed through window 107*a*. For example, in FIG. 1, the graphical indicia include indicia 117*a* and indicia 117*b* wherein the respective indicia indicate "left page" and "right page" respectively. In using bookmark 100 to indicate which page among two pages is designated to resume reading, the reader selectively translates marker 115 within the hollow sleeve of sleeve 101 such that either indicia 117*a* corresponding to the left page or indicia 117*b* corresponding to the right page is shown through window 117*a*.

Figure 2:
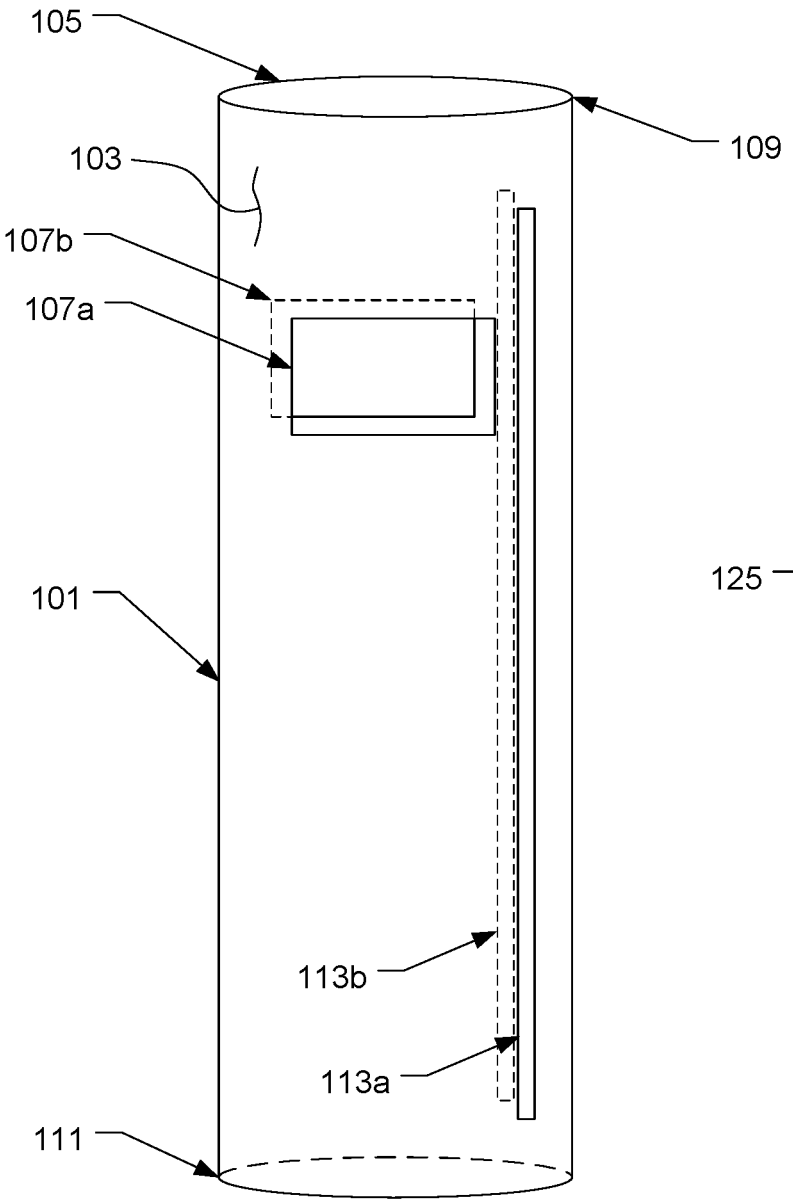
FIG. 2 is a sleeve of the bookmark assembly of FIG. 1.

Referring now to FIG. 2, sleeve 101 of bookmark assembly 100 is illustrated in accordance with the embodiment of the present invention.

In FIG. 2, sleeve 101 has a slot passing through face 103 and face 105. In other words, sleeve 101 has slot 113*a* on face 103 and slot 113*b* on face 105 wherein slot 113*a* and slot 113*b* are concentrically aligned to form a through-hole through sleeve 101. In this embodiment, sleeve 101 has window 107*a* located on face 103 between opening 109 and opening 111. Furthermore, sleeve 101 has a second window (i.e., window 107*b*) located on face 105 between opening 109 and opening 111 such that window 107*a* and window 107*b* are concentrically aligned to form a through-hole through sleeve 101.

Figure 3:
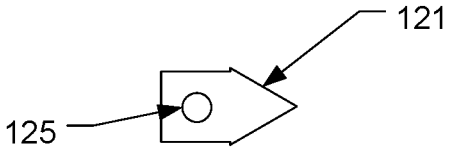
FIG. 3 is a line indicator of the bookmark assembly of FIG. 1.

Referring now to FIG. 3, line indicator 121 of bookmark assembly 100 is illustrated in accordance with the embodiment of the present invention.

Figure 4A:
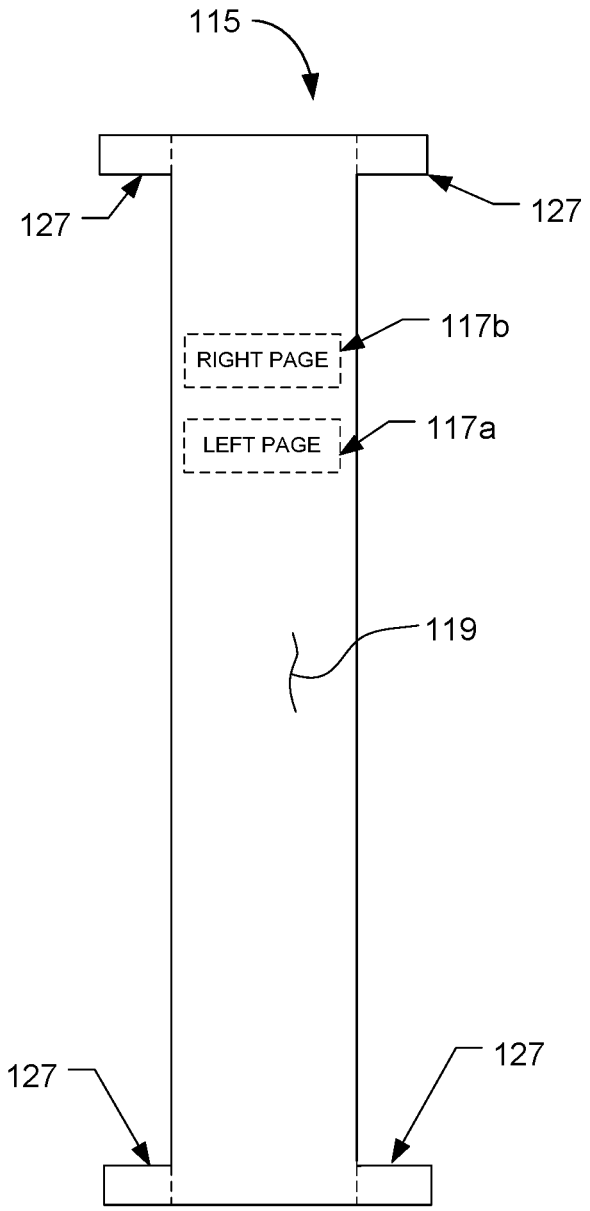
FIG. 4*a* is a front view of a marker of the bookmark assembly of FIG. 1.
Figure 4B:
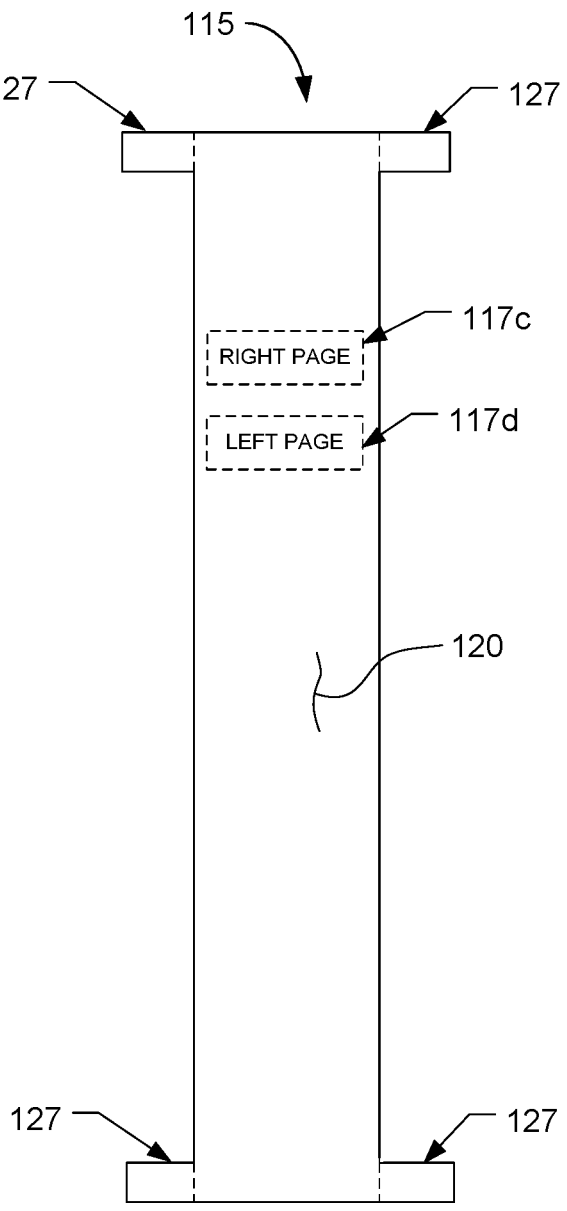
FIG. 4*b* is a back view of the marker of the bookmark assembly of FIG. 1.
Figure 5:
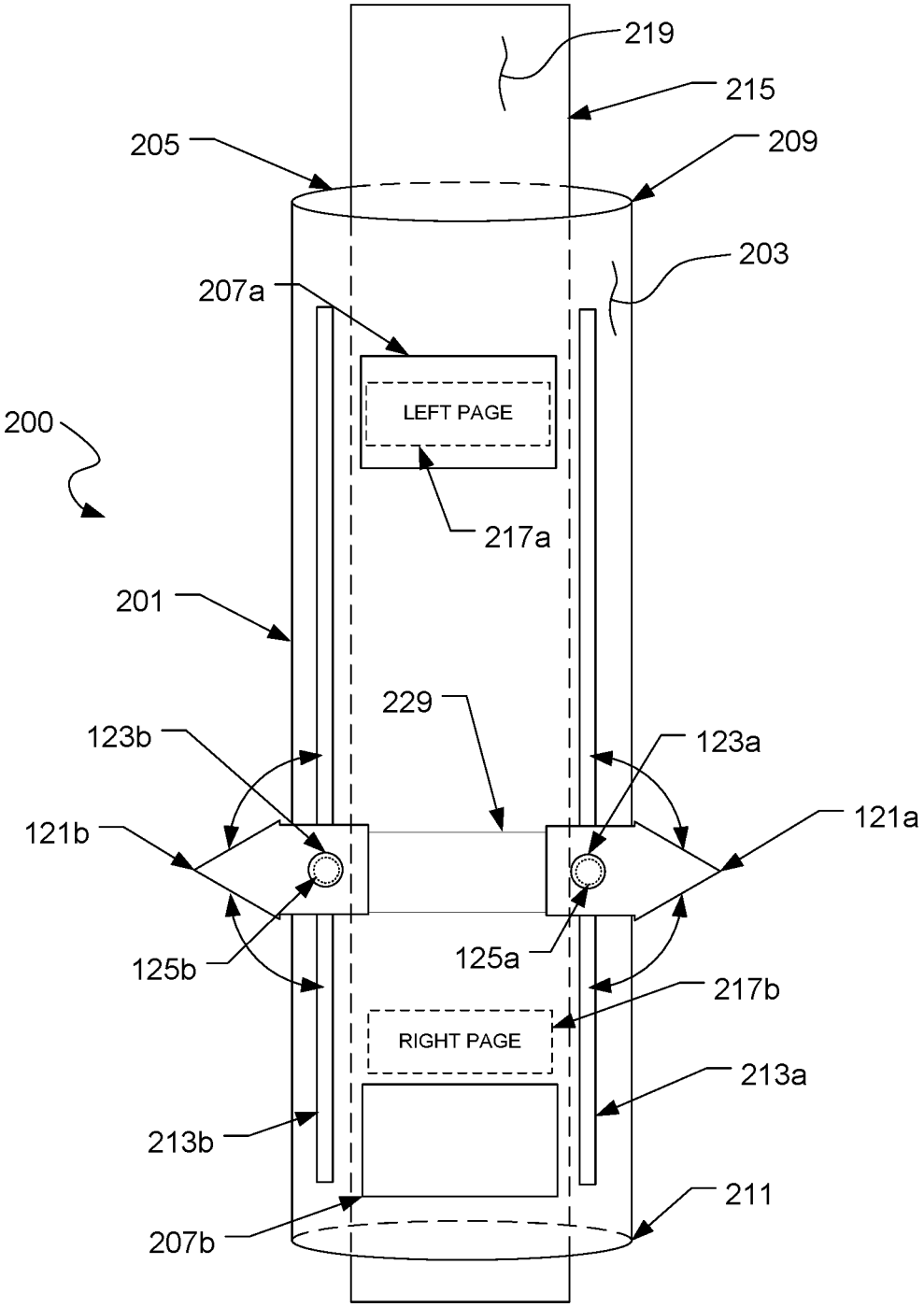
FIG. 5 is a bookmark assembly, in accordance with an embodiment of the present invention.

Referring now to FIGS. 4*a* and 4*b*, a front view and a back view of marker 115 of bookmark assembly 100 is illustrated respectfully in accordance with the embodiment of the present invention.

In FIG. 4*a*, marker 115 is shown having graphical indicia (i.e., indicia 117*a* and 117*b*) located on side 119. In this embodiment, marker 115 is configured to include a tab to selectively restrict translation through sleeve 101. For example, in FIG. 4*a*, marker 115 has tabs 127.

In FIG. 4*b*, marker 115 has graphical indicia (i.e., indicia 117*c* and 117*d*) located on a second side (i.e., side 120) of marker 115. In this embodiment, indicia 117*c* and 117*d* are of the same form and function as indicia 117*a* and 117*b* with the only difference being that indicia 117*c* and 117*d* are located on side 120 and are configured to be selectively displayed through window 107*b*.

To operate bookmark assembly 100, a reader opens a book to a page position designated for recall, wherein the book has a left page and a right page. The user adjusts marker 115 to selectively display either indicia 117*a* or 117*b*, wherein the graphical indicia corresponds to either the left page or the right page. The user then adjusts line indicator 121 to a position corresponding to a sentence location designated for recall located on either the left page or the right page. The reader then places bookmark assembly 100 at the page position of the book designated for recall, and closes the book with the placed bookmark assembly, wherein the adjusted line indicator points to the sentence position designated for recall.

The reader can then recall where the reader left off using bookmark assembly 100 by opening the book to the position based on the position of the placed bookmark assembly, determining the left page or the right page based on the selected graphical indicia, and determining the location based on the adjusted line indicator.

In one embodiment, the reader rotates a line indicator. While bookmark assembly 100 is not in use, the reader rotates the line indicator into a storage position wherein the line indicator is directed inward towards the body of bookmark assembly 100. When bookmark assembly 100 is in use, the reader rotates the line indicator into an active position wherein the line indicator is directed outwards from the body of bookmark assembly 100.

Referring now to FIG. 5, bookmark assembly 200 is illustrated in accordance with an embodiment of the present invention.

In FIG. 5, bookmark assembly 200 includes, but is not limited to, a sleeve member (i.e., sleeve 201), a set of line indicators (i.e., line indicators 121*a* and 121*b*), and a marker (i.e., marker 215). Sleeve 201 is a hollow sleeve that permits marker 215 to translate between a first opening (i.e., opening 209) and a second opening (i.e., opening 211). Sleeve 201 has a first face (i.e., face 203) and a second face (i.e., face 205). In this embodiment, sleeve 201 includes two rectangular windows (i.e., window 207*a* and 207*b*) located on face 203 between the first opening (i.e., opening 109) and the second opening (i.e., opening 211).

In this embodiment, sleeve 201 includes a slot (i.e., slot 213*a*) passing through at least one of the first face and the second face along a length of sleeve 201, and a second slot (i.e., slot 213*b*) passing through at least one of the first face and the second face along the length of sleeve 201. In this embodiment, slot 213*a* and slot 213*b* are parallel slots. In this embodiment, slot 213*b* is proximate to a second edge of sleeve 201 opposite of slot 213*a* proximate to a first edge of sleeve 201.

In this embodiment, the set of line indicators (i.e., line indicators 121*a* and 121*b*) are of same form and function as line indicator 121, wherein line indicator 121*a* has aperture 125*a*, and line indicator 121*b* has aperture 125*b*. In this embodiment, line indicator 121*a* is coupled to slot 213*a* with a fastener (i.e., fastener 123*a*) via aperture 125*a*, and line indicator 121*b* is coupled to slot 213*b* with a fastener (i.e., fastener 123*b*) via aperture 125*b* such that line indictor 121*a* and 121*b* translates along slot 213*a* and 213*b* respectively.

In this embodiment, line indicators 121*a* and 121*b* are coupled together based on a coupling band (i.e., band 229) and respective fasteners 125*a* and 125*b* that restricts line indicators 121*a* and 121*b* to translate in unison along slot 213*a* and 213*b*. In this embodiment, line indicator 121*a* is rotatable about face 203 based on fasteners 123*a* and aperture 125*a*, and line indicator 121*b* is rotatable about face 203 based on fasteners 123*b* and aperture 125*b*.

In one embodiment, band 229 is a member that couples line indicator 121*a* and 121*b* such that band 229 is permitted to translate along the body of sleeve 201 based on slot 213*a*, slot 213*b*, fastener 123*a*, and fastener 123*b*. In one embodiment, band 229 is a planar member. In an alternate embodiment, band 229 is a hollow sleeve member that is configured receive sleeve 201 through the hollow sleeve of band 229.

In this embodiment, marker 215 is a rectangular member configured to translate through the hollow sleeve of sleeve 201. In this embodiment, marker 215 has graphical indicia located on a first side (i.e., side 219) that is selectively displayed through window 207*a* or window 207*b*. For example, in FIG. 5, the graphical indicia include indicia 217*a* and indicia 217*b* wherein the respective indicia indicate "left page" and "right page" respectively. In using bookmark 200 to indicate which page among two pages is designated to resume reading, the reader selectively translates marker 215 within the hollow sleeve of sleeve 201 such that either indicia 217*a* is shown through window 207*a* or indicia 217*b* is shown through window 207*b*. For example, in FIG. 5, indicia 217*a* illustrates "left page", which is selectively shown to display through window 207*a*. Simultaneously, indicia 217*b* illustrates "right page", but is not viewable through window 207*b*.

The particular embodiments disclosed above are illustrative only, as the application may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. It is apparent that an application with significant advantages has been described and illustrated. Although the present application is shown in a limited number of forms, it is not limited to just these forms, but is amenable to various changes and modifications without departing from the spirit thereof.

What is claimed is:

1. A bookmark assembly comprising:

a hollow sleeve member having a first face and a second face, the sleeve member also including a first window, the first window located between a first opening and a second opening, the sleeve member having a slot passing through at least one of the first face and the second face along a length of the sleeve member;

a marker configured to translate through the hollow sleeve member, the marker including first graphical indicia on a first side selectively displayed through the first window;

a line indicator coupled to the slot with a fastener and configured to translate along the slot; and a second slot proximate to a first edge on the hollow sleeve body opposite the slot proximate to a second edge on the hollow sleeve body.

2. The assembly of claim 1, wherein the first window is located on the first face.

3. The assembly of claim 1, wherein the marker is configured to include a tab to selectively restrict translation through the hollow sleeve body.

4. The assembly of claim 1, wherein the sleeve member includes a second window, the first window located on the first face and the second window located on the second face.

5. The assembly of claim 4, wherein the marker includes a second graphical indicia on a second side of the marker aligned with the second window.

6. The assembly of claim 5, wherein translation of the marker adjusts the first graphical indicia visible through the first window and the second window.

7. The assembly of claim 1, wherein the sleeve member includes a second window, the first window located on the first face and the second window located on the first face.

8. The assembly of claim 7, wherein the marker includes a second graphical indicia on a first side of the marker aligned with the second window.

9. The assembly of claim 8, wherein translation of the marker adjusts the first graphical indicia visible through the first window and the second window.

10. The assembly of claim 1, wherein the line indicator is configured to rotate about the first face.

11. The assembly of claim 1, wherein the line indicator is coupled to the first face.

12. The assembly of claim 1, wherein the slot passes through the first face and the second face.

13. The assembly of claim 12, wherein the line indicator is coupled to the first face and the second face.

14. A method of using a bookmark assembly comprising:

opening a book to a position designated for recall, the position in the book having a left page and a right page;

adjusting a marker of a bookmark assembly to selectively display a graphical indicia, wherein the selectively displayed graphical indicia corresponds to either the left page or the right page;

adjusting a line indicator of a bookmark assembly to a position corresponding to a sentence location designated for recall located on either the left page or the right page;

placing the bookmark assembly at the position of the book designated for recall, wherein the adjusted line indicator points to the sentence location designated for recall;

rotating the line indicator from a storage position to an active position; and closing the book with the placed bookmark assembly located therein.

15. The method of claim 14, further comprising:

opening the book to the position of the book designated for recall within the book;

determining the left page or the right page based on the displayed graphical indicia; and determining the sentence location based on the adjusted line indicator.

16. The method of claim 14, wherein adjusting the marker of the bookmark assembly to selectively display the graphical indicia further comprises:

translating the marker through the hollow sleeve member to selectively display the graphical indicia through a window of the sleeve member.

17. The method of claim 14, wherein adjusting the line indicator of the bookmark assembly includes translating the line indicator along a slot on a hollow sleeve member of the bookmark assembly, wherein the line indicator is coupled to the slot via a fastener.

* * * * *